United States Patent [19]

Colin et al.

[11] Patent Number: 4,675,922

[45] Date of Patent: Jun. 30, 1987

[54] HYDRAULIC POWER ATTENUATOR

[75] Inventors: George M. Colin, Laguna Niguel; Edwin J. Hunter, Rancho Santa Fe, both of Calif.

[73] Assignee: Odyssey Systems Limited, Laguna Niguel, Calif.

[21] Appl. No.: 688,863

[22] Filed: Jan. 4, 1985

[51] Int. Cl.[4] ..... E04H 3/19

[52] U.S. Cl. ..... 4/502; 74/788; 74/352

[58] Field of Search ..... 4/502, 498; 242/86.52; 254/361; 415/202; 416/197 B; 74/788, 352, 353, 354, 730; 239/206, 240; 384/255, 447; 192/71, 73, 51

[56] References Cited

U.S. PATENT DOCUMENTS

| | | | |
|---|---|---|---|
| 1,108,700 | 8/1914 | Christoffel | 416/197 B |
| 1,654,031 | 12/1927 | Adragna | 415/202 |
| 2,727,402 | 12/1955 | Thoresen | 192/51 |
| 3,698,690 | 10/1972 | Beaver | 254/361 |
| 3,885,255 | 5/1975 | Vorbach et al. | 4/502 |
| 4,404,891 | 9/1983 | Turnquist et al. | 254/361 |
| 4,407,027 | 10/1983 | Colon, Jr. | 4/502 |
| 4,471,500 | 9/1984 | Long et al. | 4/502 |
| 4,491,208 | 1/1985 | Burdon, Jr. | 254/361 |

*Primary Examiner*—Stephen Marcus
*Assistant Examiner*—Linda J. Sholl

[57] ABSTRACT

A compact swimming pool cover handling system including a pair of stationary roller support members, a roller for attaching the pool cover, and a hydraulic power attenuator for operation of the system. The hydraulic power attenuator includes controls for reversing directions of the roller without removing the source of liquid operating the device.

2 Claims, 3 Drawing Figures

HYDRAULIC POWER ATTENUATOR

The present invention relates to an apparatus which converts high speed-low torque energy to low speed-high torque energy.

The invention of the present application has great utility in the swimming pool art. To prevent debris from entering an unused swimming pool, it is conventional practice to extend a cover over the surface of the water in the pool, so as to prevent debris, dust and dirt from entering into the water of the pool. When the pool is to be used, the cover must be removed. There are in existence pool cover removal systems such as the Colon U.S. Pat. No. 4,407,027. This system consisted of two support members and a rotatable tube spanning the width of the pool between such support members. The tube was rotatable and the pool cover was connected to the tube so that as the tube was rotated by handles in the support members, the tube would roll up or unroll the cover onto the surface of the pool. Pool covers, in order to be effective, have a reasonable weight, and this weight, combined with surface tension of the water acting upon the pool cover as it is being removed, creates a substantial load for manual removal of the cover by rotating the tube.

Accordingly, it is desirable to have some form of power unit which will rotate the tube and remove the cover from the surface of the pool without expending manual energy. Because of the inherent danger in the use of electricity around the pool area, utilizing an electric motor or similar electric device would entail considerable risk in providing a means to rotate the roller. In order to eliminate as many hazards as possible in the use of an electric motor and the attendant lines and connector means, the electrical system would have to be heavily insulated, thereby driving the cost of such a construction to a point where such a pool cover removal system would be available to only those who could afford the high cost of such a system.

There has been a need for an economical pool cover removal system which will operate automatically and with no expenditure of manual energy. It is submitted that the invention of the present application satisfies that need. The present invention provides a hydraulic power attenuator whereby the power attenuator can be connected to the roller in a conventional pool cover removal system, which was normally operated manually. The power attenuator would be driven by water from a garden hose connected to a source of water under conventional water pressure, available in any household. The water at household water pressure drives an impeller at high speed and through a planetary gearing system, the high speed-low torque energy developed by the impeller is converted into a low speed-high torque form of energy, which is used to rotate the roller.

The concept of using water pressure to drive a mechanism and in turn power the mechanism is known in the art, as for example Hunter U.S. Pat. Nos. 3 854,664, 4,026,471 and 4,471,908. However, these prior art systems are utilized to drive in a single direction and consequently could not be used to satisfy the requirements required in the practice of the present invention because the power attenuator must be able to drive the roller in both directions so that the cover can be removed from the pool water surface and the cover can also be unrolled from the roller to return it to the pool water surface. In addition, the power attenuator which comprises the present invention, must have a neutral position whereby the water presssure can continue to be applied to the impeller means but the power attenuator will not drive the roller. Consequently, it is imperative in the practice of the present invention that the power attenator have the capability of driving the roller in opposite directions and also being able to stop operation of the roller without removing the source of water pressure from the unit.

The principles and details of the present invention will be more clearly understood from the following description of the accomanying drawings, in which.

Figure 1:
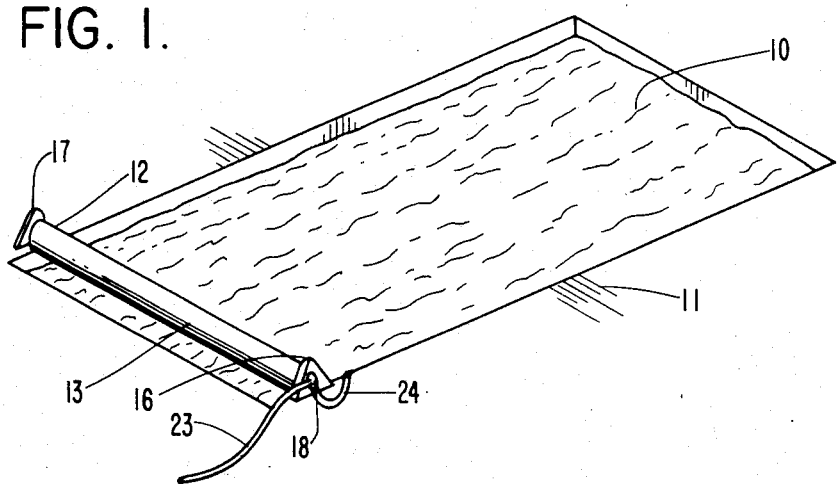
FIG. 1 shows a pool removal system in association with a swimming pool and which system has the power attenuator mounted therein.

In FIG. 1, there is shown a swimming pool 10, surrounded by a decking 11. Spanning the pool is a roller 12 carrying the pool cover 13 rolled thereon. Supporting the combination of the roller and pool cover are two end support members 16, 17. Mounted in support member 16 is the power attenuator unit 18. Attached to the inlet of the power attenuator is a garden hose 23, which is adapted to be connected, at its other end, to a conventional source of water at normal household pressure. From the outlet of the unit 18 is a further hose 24 which is shown entering the swimming pool. Thus, the water used to operate the unit is not wasted, but is used to replenish water in the pool which is lost by evaporation or splashing due to swimming activities in the use of the pool.

Figure 2:
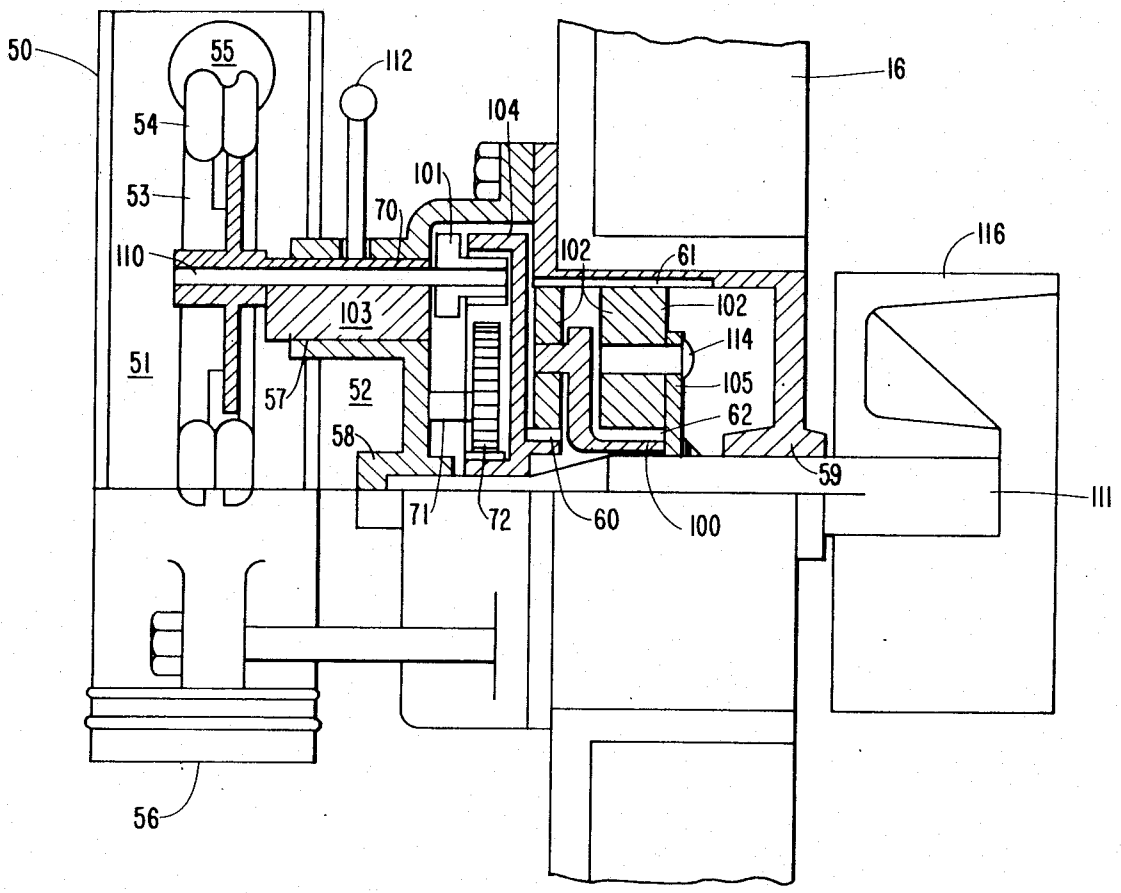
FIG. 2 is a side view, partially in section, showing the power attenuator mounted in one of the end members of the pool cover removal system.

Referring to FIG. 2, the power unit is contained within a housing 50. The housing 50 is divided into a turbine chamber 51 and a gearing chamber 52. Rotatably mounted on an input shaft 110 is a turbine wheel 53 having impeller buckets 54 around the periphery. The turbine wheel 53 is mounted so that the buckets are in line with the water inlet 55 formed in the wall of the housing 50. The exterior of the inlet provides a threaded stub (not shown) for attachment with the coupling of a conventional garden hose. At the bottom of the turbine chamber 51 is the water outlet 56, which has a threaded stub projecting from the housing and also adapted for attachment with the coupling of a conventional garden hose. As mentioned above, the water leaving the outlet 56 is conveyed by a conventional garden hose into the pool to replenish water in the pool.

The input shaft 110 having the impeller wheel 53 mounted at one end, extends through a bore in a circular eccentric bearing 103. The input shaft extends from the bearing 103 outwardly and has mounted thereon an input pinion gear 101. The eccentric bearing 103 is rotatably mounted in a longitudinal bearing support 57 formed in the housing. The housing also provides a bearing support 58 for one end of an output shaft 111. A further support for the output shaft 111 is provided by a portion 59 of the housing. The output shaft extends out of the unit and there is shown an output coupler 116 which connects with the roller so as to drive the roller.

Intermediate the input pinion 101 and the output coupler 116 is a multi-stage planetary gear system. This will now be described in greater detail. The input pinion gear 101 engages internal teeth forming a ring gear in the inwardly facing surface of a flange of a first reduction gear 104. This first reduction gear is rotatably mounted on the output shaft 111. The first reduction gear 104 provides at 60 a set of external teeth which form a sun gear of the first stage of the multi-stage planetary gear system. The teeth of the sun gear 60 engage a series of planet gears 102 rotatably carried by a planet gear carrier 106. The teeth of the planet gears 102 circumferentially spaced around the sun gear 60, also engage at their outer periphery teeth 61 formed in the internal surface of the housing. It has been found preferable that there be five planet gears 102 spaced circumferentially around the sun gear 60 and in engagement therewith. Thus, as the sun gear 60 rotates, it imparts rotational movement to the planet gears 102, and because the planet gears are engaged with the fixed teeth 61 in the housing, this causes the planet carrier 106 to rotate. The planet carrier 106 is rotatably supported by the output shaft 111 and has a circular flange extending parallel to the axis of the output shaft 111. The outwardly facing surface of this flange has teeth formed thereon, whereby the teeth on this flange act as a second sun gear 62 of a second stage of the multistage planetary gear system. The teeth of the second sun gear 62 are engaged by additional planet gears 102. The outer periphery of the additional planet gears 102 are engaged also with the teeth 61 formed in the interior surface of the housing. Preferably, two planet gears 102 are combined on each axis on a rivet 114. There are five sets of such two-planet gears in the second stage circumferentially spaced around the second sun gear 62. These are carried in an output planet carrier 105 which is securely fastened to the output shaft 111 such as by welding or any conventional means.

Thus, in operation, the impeller wheel 53 is caused to rotate at high speed by the water impinging upon the buckets 54. The high speed rotation of the impeller wheel 53 drives the input pinion gear 101 at a high rate of speed. The input pinion gear 101, being engaged with the internal teeth of the first reduction gear 104, causes the first reduction gear to rotate. Because of the small number of teeth on the input pinion gear 101 as compared to the large number of internal teeth on the first reduction gear 104, the first reduction gear 104 rotates at a much slower speed than the input pinion gear 101. This slower speed of rotation of the first-reduction gear 104 produces a similar reduced speed of rotation of the sun gear 60 of the first stage of the planetary gear system. The number of teeth in the sun gear 60 is much less than the number of teeth in the planet gears 102 and this results in a slower rotation of the planet carrier 106 which supports the planet gears 102 of the first stage. The speed of rotation of the planet carrier 106 is communicated to the planet gears 102 of the second stage of the planetary gear system, and this speed of rotation is then communicated to the output shaft 111 by means of the output planet carrier 105, which is secured to the output shaft. Thus, the high speed of rotation of the input pinion gear 101 is converted to a low speed but high torque form of energy. This low speed-high torque energy is then communicated to the roller for the swimming pool cover by means of connecting the output shaft 111 to the output coupler 116, and securing the coupler to the roller.

In the portion of the housing supporting the eccentric bearing 103, there is provided a radial slot 70. The slot has an arcuate length of approximately 75°. Extending into the slot and threaded into the eccentric bearing member 103, is a shift control lever 112. Thus, the shift control lever 112 can be moved along the arcuate slot 70, and cause the eccentric bearing member 103 to rotate about its central axis X—X. It will be noted that the axis of the input shaft 110 is laterally dispaced from the axis X—X of rotation of the eccentric bearing member 103. It is this characteristic which enables the operator of the attenuated unit to cause the roller to rotate in opposite directions or to stop rotation of the roller without disconnecting the source of hydraulic pressure provided by water entering into the turbine chamber 51. In other words, the source of pressure operating the unit need not be eliminated if the operator desires to stop operation of the roller.

Figure 3:
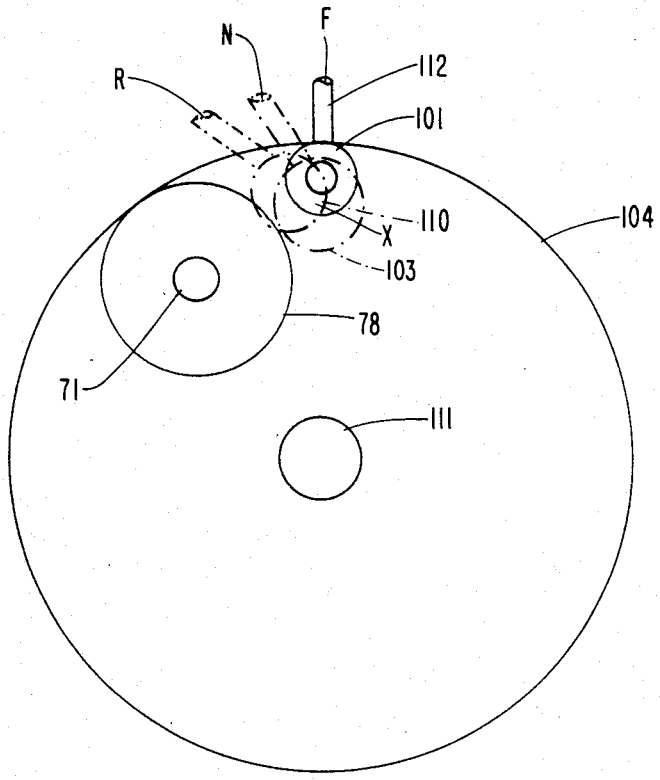
FIG. 3 is a schematic of the gearing arrangement which provides for forward, neutral and reverse operation of the roller.

FIG. 3 is a schematic of the gearing arrangement which provides for the direction change or neutral operation of the unit. The outer circle in FIG. 3 represents the pitch line of the internal teeth on the first reduction gear. Centrally depicted is the output shaft 111 upon which the first reduction gear rotates. Carried by the housing is a stub shaft 71 (shown in FIG. 2), upon which an idler gear 72 freely rotates. The pitch line of the teeth of the idler gear is depicted in FIG. 3, and it will be noted that the teeth of the idler gear 71 are also in engagement with the internal teeth of the first reduction gear. The input pinion gear 101 is depicted in FIG. 3 as being carried by the input shaft 110. Also shown in FIG. 3 is the axis X about which the input pinion gear 101 rotates when the eccentric bearing member 103 is moved by the manual shift control 112. In solid lines, the pitch line of the teeth of the input pinion gear 101 are shown engaged with the internal teeth of the first reduction gear. In phantom, the pitch line of teeth of the input pinion gear 101 are shown in enagement with the teeth of the idler gear 71. These are the two extreme positions of the input pinion gear 101, resulting from rotation of the eccentric bearing member 103. As depicted in FIG. 3, there are three symbolic positions which the input pinion gear 101 can occupy. The first is a forward position F, where the teeth of the input pinion gear 101 are engaged with the internal teeth of the first reduction gear 104. This causes the first reduction gear 104 to rotate in a prescribed direction. The direction of rotation of the input pinion gear 101 is a constant, which does not vary, because the inlet directs water in a fixed manner on the buckets of the turbine wheel 53. By rotating the eccentric bearing member 103 about half way between the extremes of movement permitted by the arcuate slot 70, a neutral position is reached wherein the teeth of the input pinion gear 101 are not engaged with the internal teeth of the first reduction gear, nor are they engaged with the teeth of the idler gear 71. This is the neutral position permitting water pressure to continue to be applied to the turbine wheel, but rotation of the roller can be stopped. Moving the manual control 112 to the other extreme position R, the teeth of the input pinion gear 101 now engage the teeth of the idler gear 71. The direction of rotation of the input pinion gear 101 is a constant. It drives the idler gear in the opposite direction of rotation, and, the idler gear in turn, engaged with the internal teeth of the first reduction gear 104, causes the first reduction gear 104 to rotate in the same direction as the rotation of the input pinion gear 101. This direction is opposite to the direction of rotation of the first reduction gear 104 when it is being driven directly by the input pinion gear 101. Consequently, you have a reversal of rotation of the entire planetary gear system by selective movement of the pinion gear from engagement directly with the internal teeth of the first reduction gear 101, to engagment with the teeth of the idler gear 71. This provides a degree of flexibility in the operation of the overall system, which has never been achieved previously.

While the invention has been described in its use with a pool cover removal system, it will be appreciated that the power attenuator unit with its flexibility of control would find utilization in other installations where the only source of power would be household water pressure. For example, because of the high torque produced at the output of the unit, it could be used as a hoist. It could also be utilized to lift heavy doors or move heavy objects such as garage doors or heavy wrought iron gates.

We claim:

1. A compact swimming pool cover handling system, comprising:

(a) a pair of stationary roller support members, one each side of a pool adjacent one end of said pool;

(b) a roller having opposite ends rotatably mounted in said support members, said roller spanning said pool and adapted to have a pool cover attached thereto;

(c) a hydraulic power attenuator mounted in at least one said support member and drivingly connected to said roller, said power attenuator having an input shaft and a liquid inlet and an outlet;

(d) a source of liquid under substantially constant pressure connected to said inlet of said power attenuator;

(e) a liquid exhaust conduit having one end connected to said outlet of said power attenuator and the other end opening into said pool; and (f) control means associated with said power attenuator to operate said roller in forward or reverse directions and to decouple the power attenuator from said roller without removing the source of liquid under substantially constant pressure from the inlet to said power attenuator, said control means including an essentric bearing, the center axis of said eccentric bearing being laterally displaced from that of said input shaft, thereby enabling said roller to be rotated in a forward or reverse direction or to be freely rotatable when said control means is in neutral position without disconnecting said hydraulic power attenuator.

2. A compact swimming pool cover handling system as claimed in claim 1, wherein said control means includes a first reduction gear, an idler gear, and an input pinion gear, said input pinion gear being carried by said input shaft, said input shaft extending through said eccentric bearing, the periphery of the teeth of said pinion gear and said idler gear lying within and partially along the periphery of the teeth of said reduction gear, such that when said eccentric bearing is moved laterally, said input pinion gear is brought into engagement with said first reduction gear or with said idler gear or into a position of non-engagement with said idler gear and said first reduction gear.

* * * * *